US005199408A

United States Patent [19]

Wataya

[11] Patent Number: 5,199,408

[45] Date of Patent: Apr. 6, 1993

[54] AIR FUEL RATIO CONTROL SYSTEM FOR INTERNAL COMBUSTION ENGINES

[75] Inventor: Seiji Wataya, Himeji, Japan

[73] Assignee: Mitsubishi Denki K.K., Tokyo, Japan

[21] Appl. No.: 825,315

[22] Filed: Jan. 27, 1992

Related U.S. Application Data

[63] Continuation of Ser. No. 625,185, Dec. 10, 1990, abandoned.

[30] Foreign Application Priority Data

Dec. 22, 1989 [JP] Japan ..... 1-333938

[51] Int. Cl.[5] ..... F02M 51/00

[52] U.S. Cl. ..... 123/672; 123/691; 123/692; 123/673

[58] Field of Search ..... 123/489, 440, 494, 480, 123/672, 673, 676, 691, 692; 204/406; 364/431.10

[56] References Cited

U.S. PATENT DOCUMENTS 3,831,564 8/1974 Schmidt et al. ..... 123/489
3,916,848 11/1975 Schmidt ..... 123/489
4,418,672 12/1983 Müller et al. ..... 123/489
4,483,300 11/1984 Hosaka et al. ..... 123/440
4,817,573 4/1989 Yamada et al. ..... 123/440
4,988,428 1/1991 Iwakiri et al. ..... 123/489
5,012,421 4/1991 Ishii ..... 123/489

FOREIGN PATENT DOCUMENTS

3620775A1 1/1987 Fed. Rep. of Germany .
3633671A1 4/1988 Fed. Rep. of Germany .
3913608A1 11/1989 Fed. Rep. of Germany .

*Primary Examiner*—Raymond A. Nelli
*Attorney, Agent, or Firm*—Sughrue, Mion, Zinn, Macpeak & Seas

[57] ABSTRACT

An air fuel ratio control system for an internal combustion engine, comprising: an internal combustion engine having a plurality of cylinders, and exhaust passages corresponding to the respective cylinders; a plurality of oxygen sensors arranged in the respective exhaust passages to detect the composition of exhaust gas from the respective cylinders; and a control unit for independently controlling an air fuel ratio of the respective cylinders based on outputs from the oxygen sensors.

2 Claims, 4 Drawing Sheets

AIR FUEL RATIO CONTROL SYSTEM FOR INTERNAL COMBUSTION ENGINES

This is a continuation of application Ser. No. 07/625,185 filed Dec. 10, 1990, now abandoned.

BACKGROUND OF THE INVENTION

1. Field of the Invention

The present invention relates to an air fuel ratio control system for internal combustion engines which utilizes an oxygen sensor to detect an air fuel ratio, and which performs feedback control based on the results of the detection.

2. Discussion of Background

An internal combustion engine which is mounted on an automobile has had a catalyst in an exhaust pipe in order to purify exhaust gas. It has widely come in practice that an oxygen sensor is utilized to detect exhaust gas composition, and that a feedback control is carried out to cause the actual air fuel ratio to become a theoretical air fuel ratio based on the results of the detection, thereby ensuring good purification efficiency.

Referring to FIG. 3, there is shown a fuel-injection system wherein such air fuel ratio control is made. In FIG. 3, reference numeral 1 designates an internal combustion engine having four cylinders. Reference numeral 2 designates an intake pipe which supplies intake air to the internal combustion engine 1. Reference numerals 3*a*, 3*b*, 3*c* and 3*d* designate injectors which are arranged in an intake manifold of the intake pipe 2 so as to correspond to the respective cylinders of the internal combustion engine 1, and which supplies fuel to the respective cylinders. Reference numeral 4 designates a throttle valve which is arranged in the intake pipe 2 to adjust the quantity of the intake air to be supplied to the engine. Reference numeral 5 designates an air flow sensor (AFS) which detects the quantity of the intake air which will be introduced into the engine. Reference numeral 6 designates an exhaust pipe which is used to discharge exhaust gas from the engine 1. Reference numeral 7 designates an oxygen sensor which is arranged in the exhaust pipe 6 to detect the concentration of oxygen in the exhaust gas. Reference numeral 8 designates a catalytic converter which is arranged in the exhaust pipe 6 to purify the exhaust gas by use of a catalyst. Reference numeral 9 designates a revolution sensor which generates a pulse signal depending on the revolution of the engine 1. Reference numeral 10 designates an electronic control unit (ECU) which computes a required amount of fuel supply based on input information indicative of engine operating conditions which are detected by the air flow sensor 5, the oxygen sensor 7, the revolution sensor 9 and the like. The electronic control unit produces a signal indicative of the computed results to drive the injectors 3*a*–3*d*.

In such arrangement, the electronic control unit 10 uses as the main information an intake air quantity signal which is detected by the air flow sensor 5, and a pulse signal which is obtained by the revolution sensor 9. The electronic control unit 10 computes a basic fuel-injection quantity based on the main information to determine a driving pulse width for the injectors 3*a*–3*d*. The injectors 3*a*–3*d* are pulse-driven in sequence based on a given revolution signal, and the fuel is injected into an intake manifold in the amount corresponding to the pulse width.

In the control wherein such computation is carried out to set a required quantity of the fuel, the actual air fuel ratio does not always correspond to the theoretical air fuel ratio. The actual air fuel ratio varies in the range of about 4 to about 5% with respect to the theoretical air fuel ratio due to an operation error of the injectors 3*a*–3*d* and a detection error of the air flow sensor 5. In order to cope with this problem, the conventional fuel-injection system includes the oxygen sensor 7 to detect the concentration of oxygen in the exhaust gas, and carries out feedback control based on an output signal from the oxygen sensor, thereby trying to cause the actual air fuel ratio to correspond to the theoretical air fuel ratio. The oxygen sensor 7 outputs an output voltage, the sign of which reverses using the theoretical air fuel ratio as a reference as shown in FIG. 4. The quantity of fuel is increased and decreased depending on the reversal of the output voltage to carry out feedback control, having the theoretical air fuel ratio as the target as shown in FIG. 5. In that manner, the catalytic converter 8 can ensure the purification efficiency of the exhaust gas at the maximum, thereby minimizing effect on the environment.

In such a conventional air fuel ratio control system, the output signal from the oxygen sensor 7 in fact indicates an average of the values which could be gotten in the plural cylinders. As a result, there is a variation in the actual air fuel ratio of the respective cylinders with respect to the theoretical air fuel ratio as shown in FIG. 6. It means that the purification efficiency in the catalytic converter 8 can not be maintained an ideal value, causing the exhaust gas from the internal combustion engine 1 to have adverse effect on the environment.

SUMMARY OF THE INVENTION

It is an object of the present invention to eliminate the disadvantage of the conventional air fuel ratio control system and to provide a new and improved air fuel ratio control system for internal combustion engines capable of maintaining exhaust gas from cylinders at a theoretical air fuel ratio.

The foregoing and other objects of the present invention have been attained by providing an air fuel ratio control system for internal combustion engines, comprising an internal combustion engine having a plurality of cylinders, and exhaust passages corresponding to the respective cylinders; a plurality of oxygen sensors arranged in the respective exhaust passages to detect the composition of exhaust gas from the respective cylinders; and a control unit for independently controlling an air fuel ratio of the respective cylinders based on outputs from the oxygen sensors.

In a preferred embodiment, the air fuel ratio control system according to the present invention further includes a plurality of injectors for supplying fuel, which are arranged to correspond to the respective cylinders; wherein when the output from one of the oxygen sensors is continuously at a rich or lean level for at least a predetermined period the injector which corresponds to the one oxygen sensor at the rich or lean level is prevented from working to stop the fuel supply to the corresponding cylinder.

In accordance with the present invention, the adjustment of the air fuel ratio in the respective cylinders can be under feedback control based on the output from the corresponding oxygen sensor to maintain the exhaust gas from the respective cylinders at a theoretical air fuel ratio.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
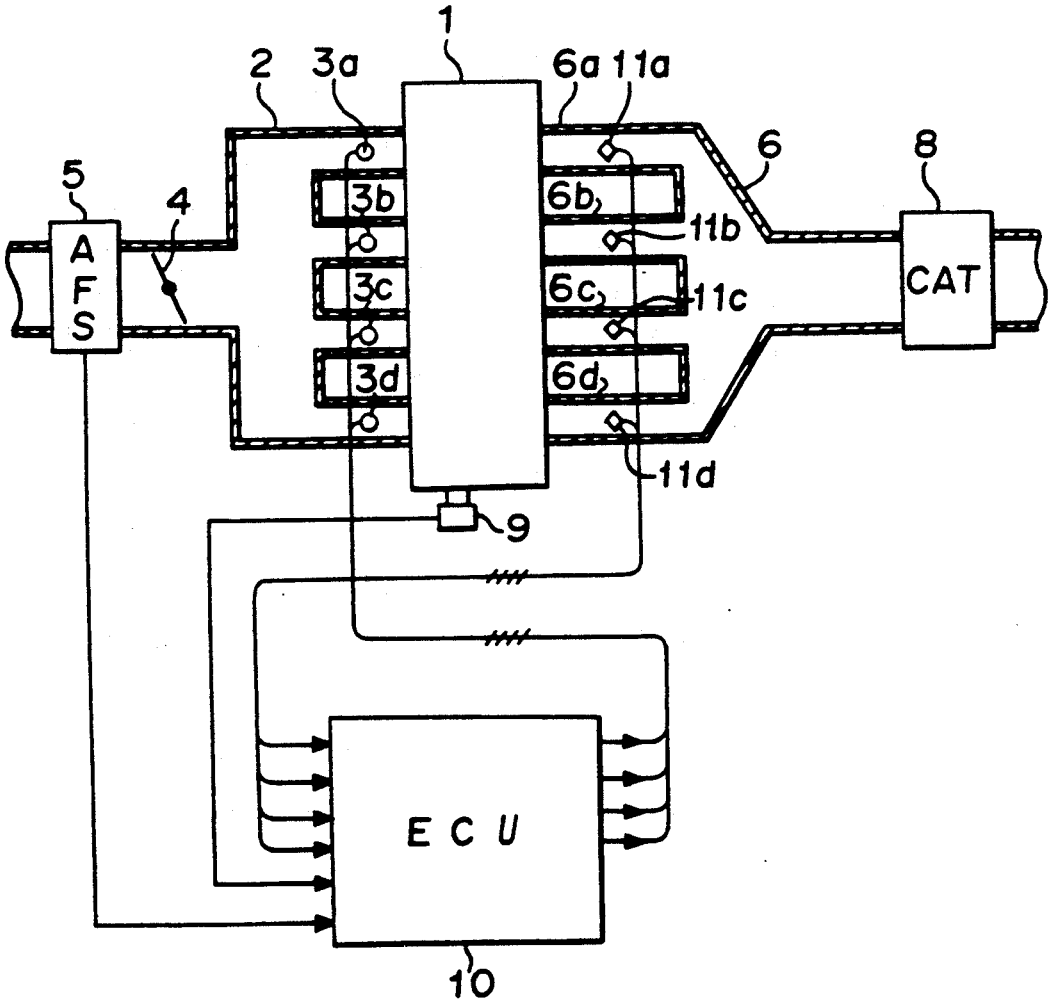
FIG. 1 is a schematic view showing an embodiment of the air fuel ratio control system according to the present invention.
Figure 3:
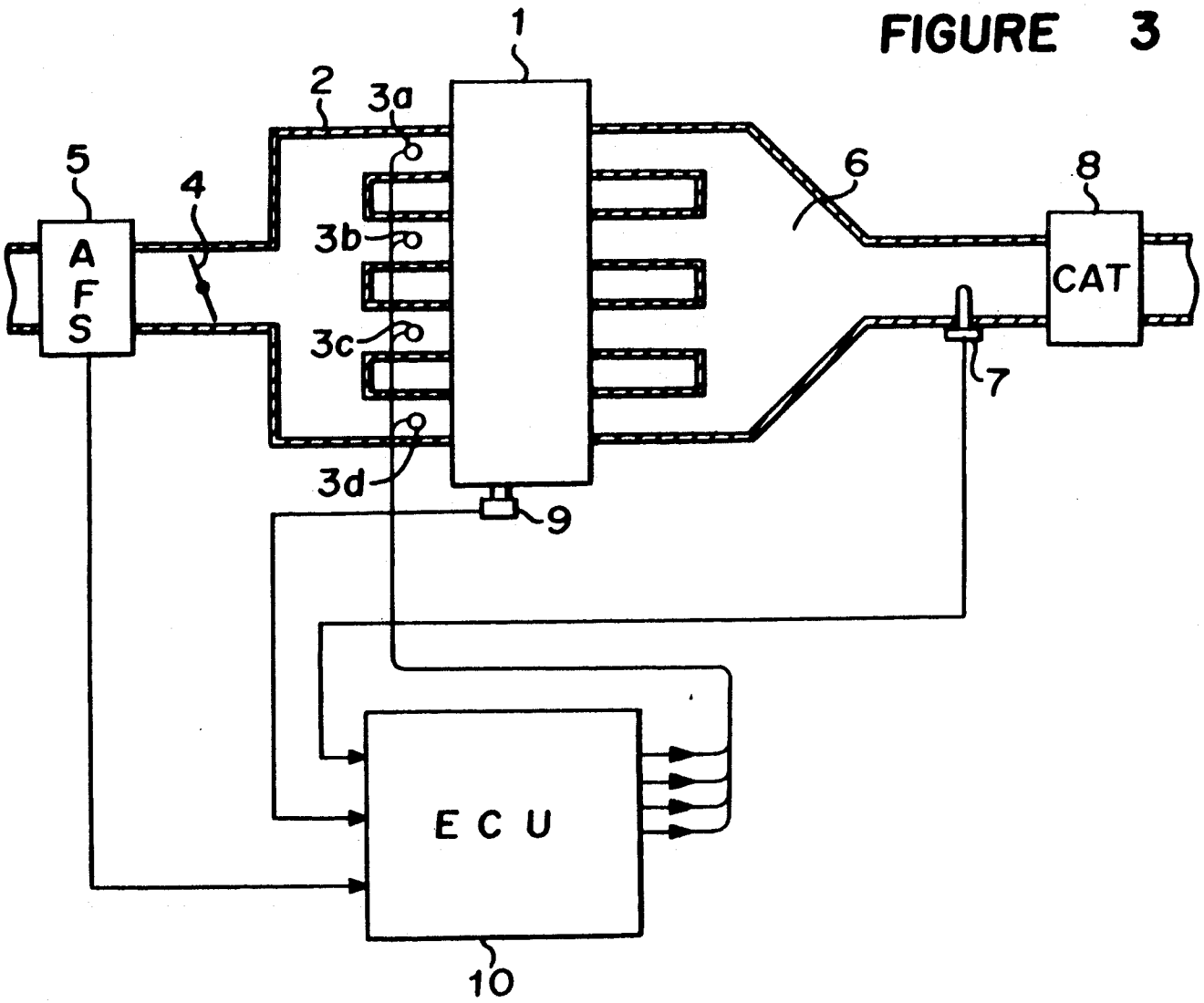
FIG. 3 is a schematic view showing a conventional air fuel ratio control system.
Figure 4:
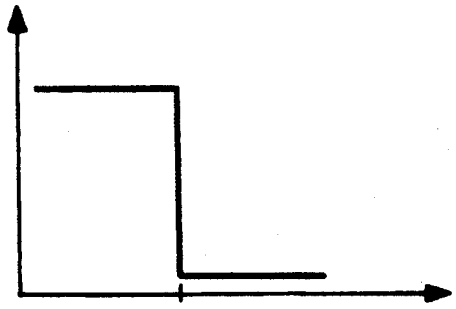
FIGS. 4 through 6 are schematic diagrams to help explain the operation of the conventional system.
Figure 5:
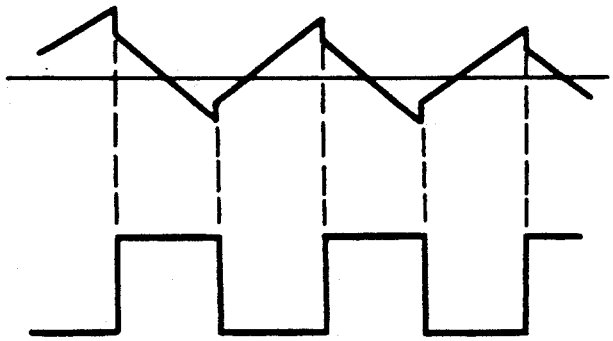
Figure 6:
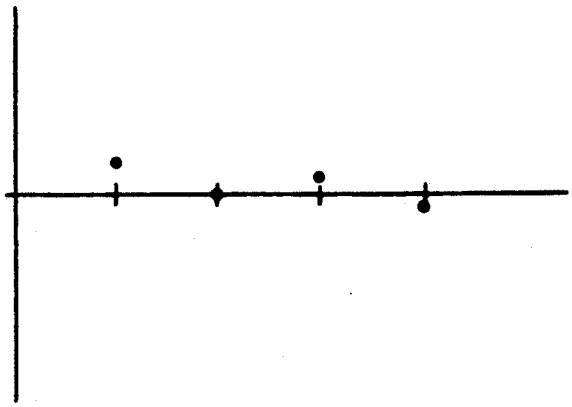

Referring now to the drawings, wherein like reference numerals designates identical or corresponding parts throughout several views, and more particularly to FIG. 1 thereof, there is shown a schematic view of the structure of a typical example of the air fuel ratio control system according to the present invention. In FIG. 1, explanation of the parts indicated by the same reference numerals as those in FIG. 3 will be omitted for the sake of simplicity.

Figure 2:
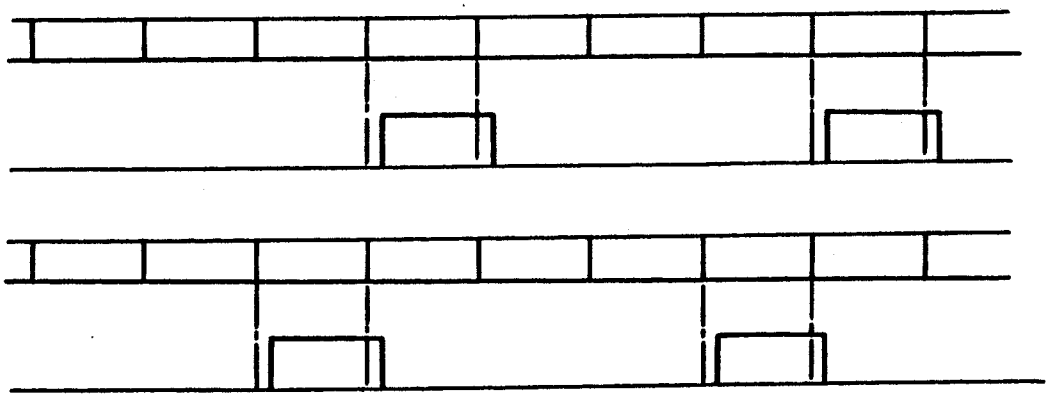
FIG. 2 is a schematic diagram showing operation timing of the system of FIG. 1.

In FIG. 1, reference numerals 11*a*, 11*b*, 11*c* and 11*d* designate oxygen sensors which are arranged in exhaust passages 6*a*, 6*b*, 6*c* and 6*d* of an exhaust manifold, the passages being independently formed to lead to the respective cylinders of an internal combustion engine 1. The oxygen sensors 11*a*–11*d* supplies an electronic control unit (ECU) 10 with output signals. The ECU 10 reads output voltages from the oxygen sensors 11*a*–11*d* when the respective cylinders are in the exhaust stroke. The ECU 10 increases and decreases the quantity of fuel supply so that the sign of the respective output voltages is reversed. The output voltages from the oxygen sensors 11*a*–11*d* can be read during the opening period of the exhaust valves of the respective cylinders, or in a period which is slightly later than the opening period of the exhaust valves as shown in FIG. 2, thereby avoiding the detection of the exhaust gas from exhaust passages 6*b*, 6*c* and 6*d* by, for example, oxygen sensor 11*a*. In FIG. 2, the period D corresponds to the exhaust phase of each cylinder of the engine.

As a result, the oxygen sensors 11*a*–11*d* can exactly detect the exhaust gas composition in the respective cylinders of the engine 1. In this manner, the ECU 10 can control injectors 3*a*–3*d* based on the outputs from the oxygen sensors so that the actual air fuel ratio can approach a theoretical air fuel ratio.

The arrangement wherein the oxygen sensors 11*a*–11*d* are arranged so as to correspond to the respective cylinders allows a true air fuel ratio to be detected for each cylinder. The respective cylinders can be controlled based on outputs indicative of the real air fuel ratio so as to have the theoretical air fuel ratio, thereby enabling a catalytic converter 8 to maintain the best purification efficiency of the exhaust gas.

If any one of the cylinders misfires for some reason, unburned gas is exhausted into an exhaust pipe 6, leading to environmental pollution. In accordance with the present invention, the one of the oxygen sensors 11*a*–11*d* which corresponds to the misfired cylinder continuously produces an output indicative of a rich or lean state in that case. When the rich or lean state is found to continue for a predetermined period or longer based on the output signal from the oxygen sensor corresponding to the misfired cylinder, the injector 3*a*, 3*b*, 3*c* or 3*d* which corresponds to the misfired cylinder can be prevented from working to stop the supply of fuel, thereby avoiding the exhaust of the unburned gas.

The ECU 10 can be constituted by an analog type electronic circuit or a microcomputer as is well known in the art. Although the explanation of the embodiment has been made with respect to the internal combustion engine having four cylinders, the present invention can be also applied to internal combustion engines having a plurality of cylinders in addition to four cylinder internal combustion engines.

Obviously, numerous modifications and variations of the present invention are possible in light of the above teachings. It is therefore to be understood that within the scope of the appended claims, the invention may be practiced otherwise than as specifically described herein.

What is claimed is:

1. An air fuel ratio control system for internal combustion engines, comprising:

an internal combustion engine having a plurality of cylinders, and an equal plurality of exhaust passages corresponding to the respective cylinders;

an equal plurality of oxygen sensors individually arranged in the respective exhaust passages to detect the composition of exhaust gas from the respective cylinders;

a control unit for independently controlling an air fuel ratio for each of the cylinders based on individual outputs from the respective oxygen sensors; and reading means for individually reading the outputs of the oxygen sensors only during time periods when exhaust valves of the respective cylinders are open or have recently closed, such that remnant exhaust gases from other cylinders do not adversely affect the accuracy of readings from the oxygen sensors.

2. An air fuel ratio control system according to claim 1, further comprising:

a plurality of injectors for supplying fuel, which are arranged to correspond to the respective cylinders; wherein when the output from one of the oxygen sensors is continuously at a rich or lean level for at least a predetermined period of time the injector which corresponds to the oxygen sensor at the rich or lean level is prevented from working to stop the fuel supply to the corresponding cylinder.

* * * * *